US007210493B1

(12) United States Patent
Wang

(10) Patent No.: US 7,210,493 B1
(45) Date of Patent: May 1, 2007

(54) FAUCET ASSEMBLY MOUNTING APPARATUS

(76) Inventor: Seung Tae Wang, 8626 Chase Glen Cir., Fairfax Station, VA (US) 22039

( * ) Notice: Subject to any disclaimer, the term of this patent is extended or adjusted under 35 U.S.C. 154(b) by 0 days.

(21) Appl. No.: 11/329,117

(22) Filed: Jan. 11, 2006

(51) Int. Cl.
*B08B 7/00* (2006.01)
*F16L 5/00* (2006.01)

(52) U.S. Cl. ..... 137/15.01; 137/359; 137/360; 4/695

(58) Field of Classification Search ..... 137/359, 137/360, 15.01; 4/695
See application file for complete search history.

(56) References Cited

U.S. PATENT DOCUMENTS

| | | | | |
|---|---|---|---|---|
| 1,667,124 | A * | 4/1928 | Liniger | 285/23 |
| 1,835,301 | A | 12/1931 | Hennessey | |
| 3,009,167 | A * | 11/1961 | Leonard, Jr. | 4/695 |
| 3,010,474 | A * | 11/1961 | Moen | 137/359 |
| 3,443,266 | A | 5/1969 | Mongerson et al. | |
| 3,609,774 | A | 10/1971 | Allgood | |
| 3,669,141 | A | 6/1972 | Schmitt | |
| 4,457,031 | A | 7/1984 | Moore | |
| 4,762,143 | A | 8/1988 | Botnick | |
| 4,848,395 | A | 7/1989 | Krippendorf | |
| 5,010,922 | A | 4/1991 | Agresta | |
| 5,725,008 | A * | 3/1998 | Johnson | 137/15.17 |
| 5,813,431 | A * | 9/1998 | Cool et al. | 137/360 |
| 5,894,613 | A * | 4/1999 | Fenn | 4/678 |
| 6,065,491 | A * | 5/2000 | Rider | 137/360 |
| 6,076,204 | A | 6/2000 | Mullick | |
| 6,301,728 | B1 | 10/2001 | Pilatowicz et al. | |
| 6,370,712 | B1 | 4/2002 | Burns et al. | |
| 6,385,798 | B1 | 5/2002 | Burns et al. | |
| 6,401,748 | B1 * | 6/2002 | Wang | 137/359 |
| 6,792,629 | B2 | 9/2004 | Nelson et al. | |
| 7,039,966 | B1 | 5/2006 | Cranston, Jr. | |

* cited by examiner

*Primary Examiner*—A. Michael Chambers
(74) *Attorney, Agent, or Firm*—Browdy and Neimark, PLLC

(57) ABSTRACT

A mounting apparatus for a faucet assembly that includes a mounting plate and a backing plate that clampingly attach to a surface such as a sink, bathtub, countertop or shower wall. The surface includes a large opening through which a user may access the hot and cold water lines with their shut-off valves. The hot and cold water lines are attached through flexible hoses to the faucet assembly. The faucet assembly is attached to the outer mounting plate whereby when the mounting plate is detached from the backing plate the flexible hoses allow the mounting plate with the faucet assembly to be moved away from the surface to access the water lines and/or repair or replace the faucet assembly.

17 Claims, 7 Drawing Sheets

FAUCET ASSEMBLY MOUNTING APPARATUS

FIELD OF THE INVENTION

The invention relates to plumbing mounting installations and particularly to easily mounted and accessible faucet water valve assemblies.

BACKGROUND OF INVENTION

Many faucet assemblies are shown in the prior art that avoid the cramped and tight spaces beneath a sink by providing top mounted faucets. For example U.S. Pat. No. 4,848,395 to Krippendork, U.S. Pat. No. 6,792,629 to Nelson et al, U.S. Pat. No. 5,010,922 to Agresta, U.S. Pat. No. 3,669,141 to Schmitt, U.S. Pat. No. 6,301,728 to Pilatowicz et al, U.S. Pat. Nos. 6,370,712 and 6,385,798 to Burns et al relate to faucet assemblies that can be mounted on a countertop, vertical wall or other surface without requiring access to the other side of the surface.

In Krippendorf, a back-up plate 10 is inserted into an opening in the surface C, a top plate 17 is placed over the bolt 14 on the back-up plate 10 and another bolt is screwed into the plate 10 to clamp the two plates to the surface C. The faucet is then screwed by bolts 6 to the top plate 17.

In U.S. Pat. No. 4,762,143 to Botnick, a faucet manifold is provided that mounts to a countertop over water-conveying access openings. Valve members, water-conveying conduits and a spout assembly are connected to and carried by the plate. The plate is connected to the countertop by toggle bolts.

In U.S. Pat. No. 6,609,774 to Allgood, a roughing-in frame and access panel is disclosed for the faucet valve stem of a shower. The roughing-in frame is first attached to wall stud 13*e*, 13*f* and the panel 30 is placed thereover, being held by the handles 32*a*–*c* and spout 33.

U.S. Pat. No. 1,835,301 to Hennessey shows a plumbing fixture panel 66 that covers a recess 23 in a shower wall, a support 24 that receives valve supporting plate 25 within the wall, and the valve stems and shower head that projects through the panel.

U.S. Pat. No. 3,443,266 to Mongerson et al discloses a bathtub plumbing fixture having a mounting plate 38 situated on the inner side of shower wall 30 and plate 28 connected together by bolts 42 to sandwich and clamp the wall surface 30 therebetween. The mixing valve 50 may be attached to the mounting plate 38 by screws. The mounting plate 38 could be attached to an interior 2×4 extending between wall studs.

U.S. Pat. No. 4,457,031 to Moore shows a modular pre-plumbed shower unit in which a wall 11 having an opening through which water lines 32, 32' having extensions 33, and 33' protrude, and plumbing tree 25 connected by brackets 36 to wall 11. The tree 25 has a control valve 26, conduits 27, 28 for connection of shower fixture 13 and tub spout 14, and a shell 17 secured to the plumbing tree and overlying the wall. The shell has openings through which the shower fixture, tub spout and control valve handle extend.

U.S. Pat. No. 6,076,204 to Mullick discloses a modular bathing unit that has a module 526 with water, control and electrical lines interfitted with the water, control and electrical lines of feeder section 86 during installation.

SUMMARY OF INVENTION

The invention comprises a mounting plate and backing plate for a faucet assembly, the mounting plate being attached to the backing plate and the faucet assembly being attached to the mounting plate. An access opening provided in a surface such as a sink, countertop, tub or shower wall mounts on an inside surface thereof the annular backing plate. The access opening is large enough for a user to access the water lines when the mounting plate with the faucet assembly thereon is detached from the backing plate and moved away from the surface. Flexible or extendible hoses allow movement of the mounting plate away from the surface without detaching the water connections so that the faucet assembly can be easily repaired or replaced.

BRIEF DESCRIPTION OF DRAWINGS

For a more complete understanding of the present invention, reference is now made to the following description of embodiments of the invention conjunction with the accompanying drawing figures, wherein.

DETAILED DESCRIPTION OF EMBODIMENTS

Figure 1:
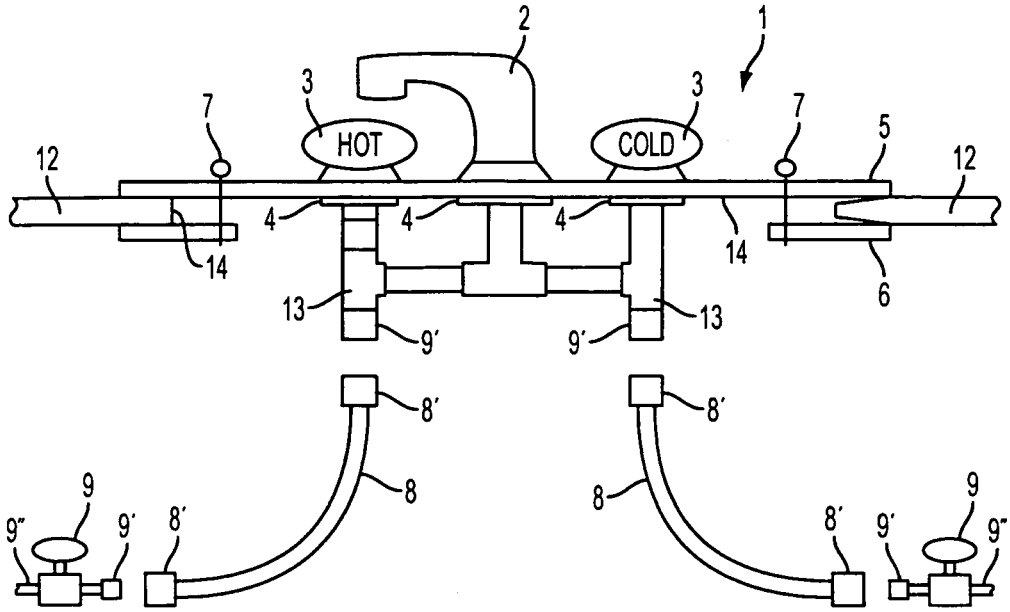
FIG. 1 is a side view of one embodiment of the invention with the faucet assembly installed.

FIG. 1 shows a side view of one embodiment of the invention. The faucet spout 2, valves 13 and handles 3 are attached to the mounting plate 5 by the customary fastening nuts 4. Screws 7 are used to attach the mounting plate 5 to the backing plate 6 which has been previously attached to the underside of a surface 12 such as a countertop, sink top or bath rim around a large access opening 14 in the surface 12.

Figure 2:
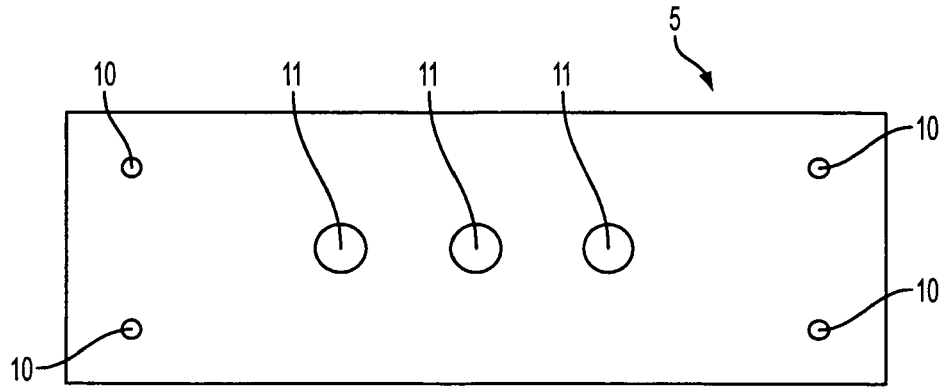
FIG. 2 is a top view of the mounting plate according to one embodiment of the invention.
Figure 3:
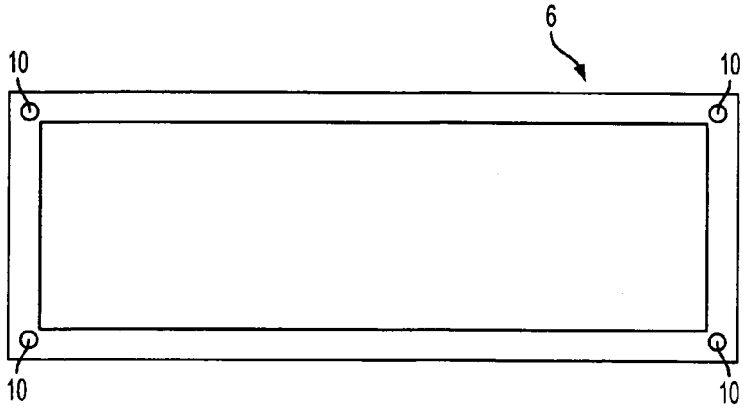
FIG. 3 is a top view of the backing plate according to one embodiment of the invention.

The mounting plate 5 is shown more particularly in top view in FIG. 2 as being rectangular and having screw holes 10 and valve and spout pipe openings 11. The backing plate 6, shown more particularly in FIG. 3, is of rectangular, annular shape having screw holes 10 corresponding to the screw holes 10 in the mounting plate 5.

Flexible steel water lines 8 having female connectors 8' attach to the male connectors 9' on the faucet assembly and shut-off valves 9 as shown in FIG. 1. The flexible steel lines 8 have enough slack such that when the mounting plate with the faucet assembly thereon is moved away from the surface 12, the faucet assembly can be easily repaired or removed from the mounting plate 5. During repair the flexible lines 8 may be detached from the valve assembly after the shut-off valves 9 are used to shut off the water supply.

During installation of the faucet assembly, the faucet and valves 2, 13 are first attached to the mounting plate 5. The backing plate 6 has been previously positioned on the underside of the surface, either by permanently attaching it to the surface by screw fasteners (not shown) for example, or temporarily (or permanently) gluing it thereto. The mounting plate 5 is thereafter placed on the surface, the screw holes 10 in the plates 5 and 6 are aligned, and each of the screws 7 inserted and tightened through the aligned holes 10. The holes 10 may have screw threads for this purpose or the threads may be formed as the screws are being screwed into the holes as one of ordinary skill in the art would readily comprehend. The surface 12 is therefore sandwiched and clamped by the mounting and backing plates to form a rigid connection.

The water lines 8 may be attached to the valve assembly prior to the mounting plate 5 being mounted on the surface, or if enough room is provided underneath the surface 12 (such as a sink cabinet), the water lines 9" may be attached after mounting of the plate 5 to the plate 6. However, the large access opening in the surface allows an installer to attach the lines 8 to the incoming water lines 9" provided with the shut-off valves 9 without having to work through the side of the surface, e.g. through the cabinet door opening.

The surface 12 could also be the vertical wall of a shower (see the description of FIGS. 5–18 below).

The shape of the mounting and backing plates do not necessarily have to be rectangular, but could be any shape corresponding to the shape of the surface on which they are mounted, or for aesthetic purposes. For example, triangular, square, circular, oval or pentagram shapes are also contemplated and within the scope of the invention.

Furthermore, the shape of the large access opening need not be rectangular and the particular fastening devices for the plates need not be screws—bolts, adhesive and snap fit types of fasteners also being contemplated. The particular material of which the plates are made could be metal, fiberglass, ceramic, marble, wood, plastics, etc. as long as the material is rigid enough to adequately support the faucet assembly.

Also the term "faucet assembly" for the purposes of this description is a liquid valve assembly with or without a spout.

Figure 4:
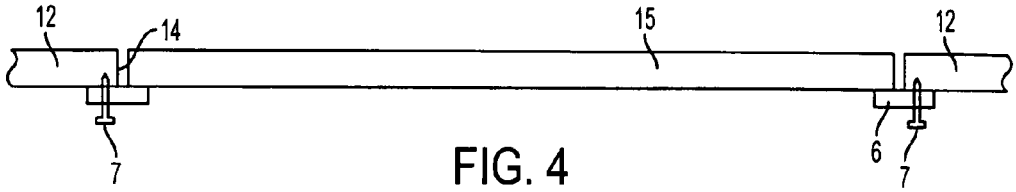
FIG. 4 is a side view of an alternate mounting plate according to another embodiment of the invention.

Another way to carry out the invention is shown in FIG. 4. Here the mounting plate 15 is shown fitted snugly in the access opening 14 and supported by the backing plate 6. The backing plate 6 may be attached to the underside of the surface by screw fasteners 7 or adhesive.

Further, the type of faucet assembly used in the present invention could be of any well known type, such as one in which the pipes connecting the valves 13 on the faucet are located above the mounting plate. Also a one-handle type of faucet could be used that would require one or two of the openings 11 in the mounting plate 5.

Figure 5:
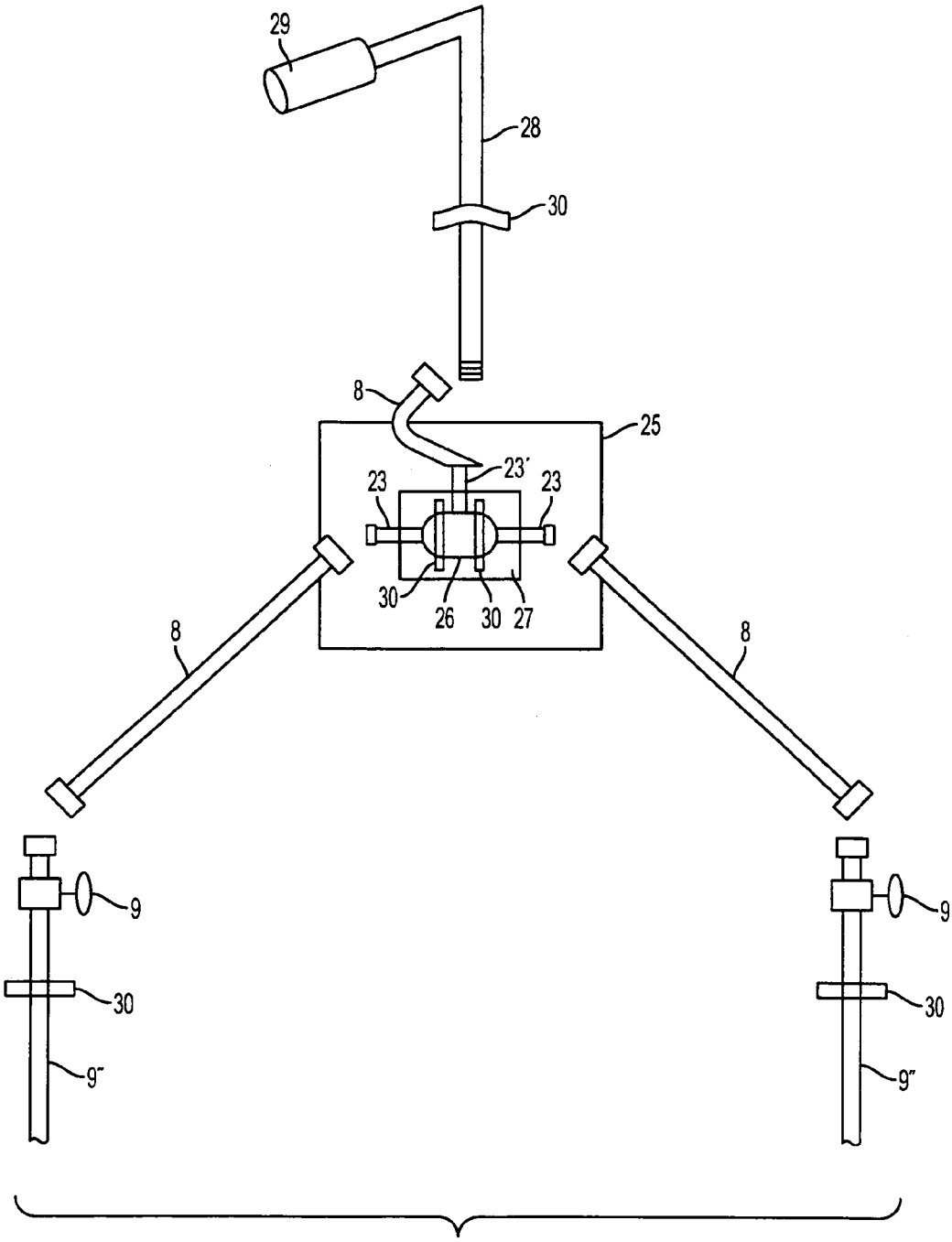
FIG. 5 is a rear view of another embodiment of the invention used in a shower showing the attachment of the water lines and shower head.

FIG. 5 discloses an embodiment of the invention that is used in a shower, and showing a view of the rear or back side of the mounting plate with the various water line connections. The mounting plate 25 has the valve mechanism 26 attached thereto. Hot and cold water pipes are connected via shut-off valves 9 to the flexible hoses 8. Hoses 8 are constructed to be removably attached to the valve mechanism water connections 23. An output connection 23' of the valve mechanism 26 is attached to a flexible hose 8 that is removably connected to the shower pipe 28 and shower head 29. The pipe 28 and incoming water lines 9" are braced by braces 30 to the shower wall itself or to the wall framing. The valve mechanism 26 is also braced by braces 30 to a brace plate 27 that forms part of the mounting plate 25.

Figure 6:
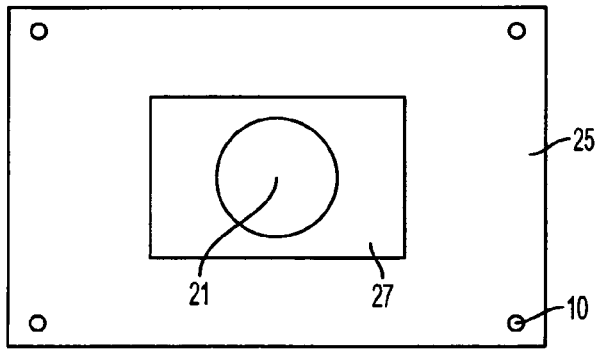
FIG. 6 is a rear view of the mounting plate used in the embodiment of FIG. 5.
Figure 7:
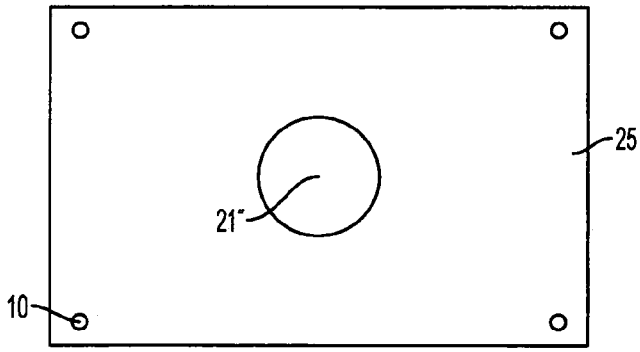
FIG. 7 is a front view of the mounting plate used in the embodiment of FIG. 5.
Figure 8:
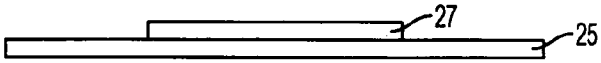
FIG. 8 is a side view of the mounting plate of FIG. 6.

FIGS. 6–8 show the back (inside the shower wall), front and side views of the mounting plate 25. The plate 25 includes the bracing plate 27, screw holes 10 and valve mechanism mounting opening 21. The valve mechanism 26 is a single handle valve in this embodiment that is attached to the mounting plate in any conventional manner through the opening 21.

The backing plate 6 is in the same form as in FIG. 3. The backing plate can be attached to the shower wall in any convenient manner, such as by adhesive. The mounting plate is attached to the backing plate by screws 7 or other well known fasteners.

Figure 9:
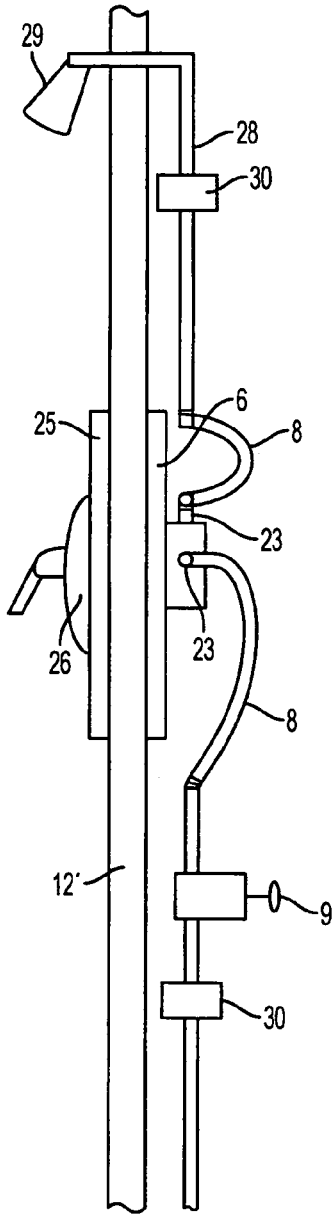
FIG. 9 is a side view of the FIG. 5 embodiment attached to a shower wall.

In FIG. 9 is shown the invention in assembled position on a shower wall in side view.

Similar to the embodiments of FIGS. 1–5, the mounting plate of FIG. 9 may be detached from the backing plate and moved away from the shower wall for repair or replacement of the valve mechanism. Since the shower wall has a large access opening and the water lines 8 are flexible and can be extended out from the shower wall, and because the shut-off valves 9 are easily accessible, repair or replacement of the valve mechanism is easily accomplished.

Figure 10:
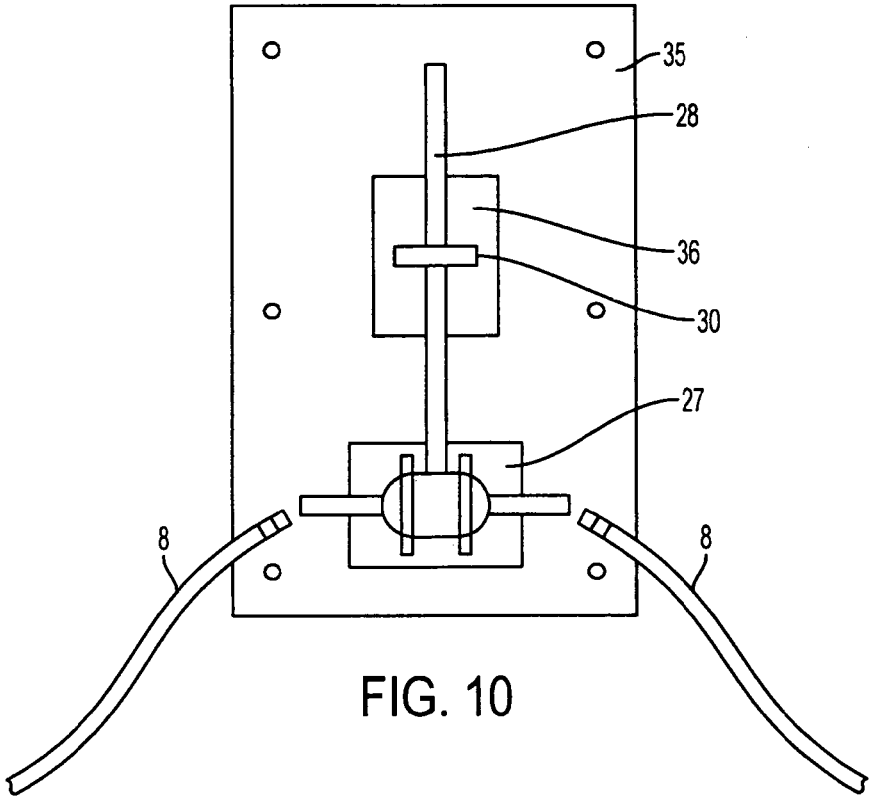
FIGS. 10–11 are back and front views of a modified mounting plate to accommodate the shower head and pipe.
Figure 11:
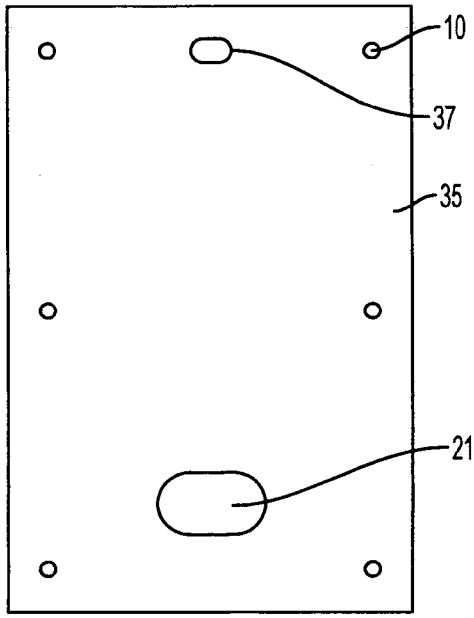

FIGS. 10–11 show back (inside) and front views of another modification of the shower valve mechanism mounting similar to that of FIGS. 6–9 but which also mounts the shower pipe 28. As seen in these figures, the mounting plate 35 includes an additional opening 37 for extending the shower pipe therethrough and includes a bracing plate 36 and brace 30 for attaching the pipe 28 to the mounting plate 45.

Figure 12:
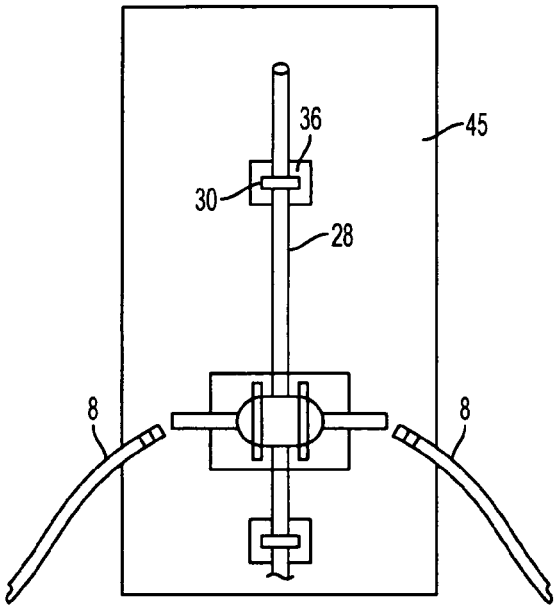
FIGS. 12–13 are back and front views of another modified mounting plate to accommodate the shower head and bath spout.
Figure 13:
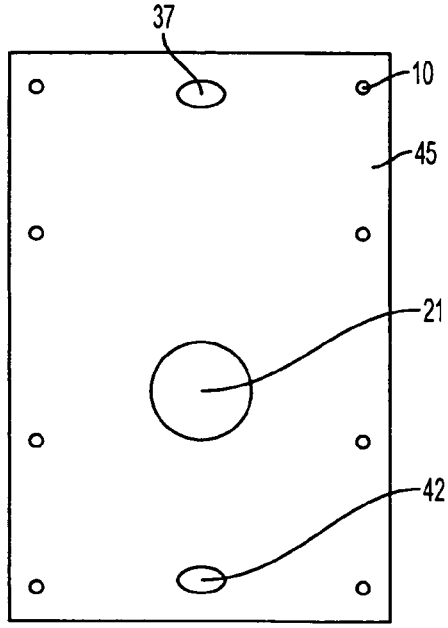
Figure 14:
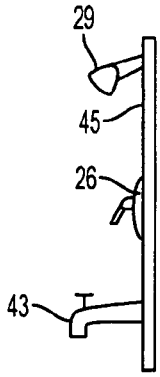
FIG. 14 is a side view of the assembled mounting plate of FIGS. 13–14.

FIGS. 12–14 is another modification wherein the mounting plate 45 includes not only openings 37 and 21 for the shower pipe and valve mechanism respectively, but also an opening 42 for the bath spout 43. Thus all of the shower plumbing elements are attached to the mounting plate in this example.

Figure 15:
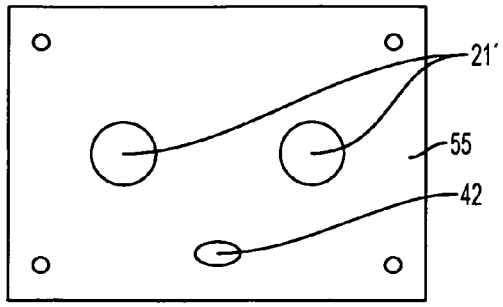
FIGS. 15–17 are further modifications of the mounting plate to accommodate a double handle valve and bath spout, a double handle valve and shower head, and double handle valve/shower head/bath spout, respectively.
Figure 16:
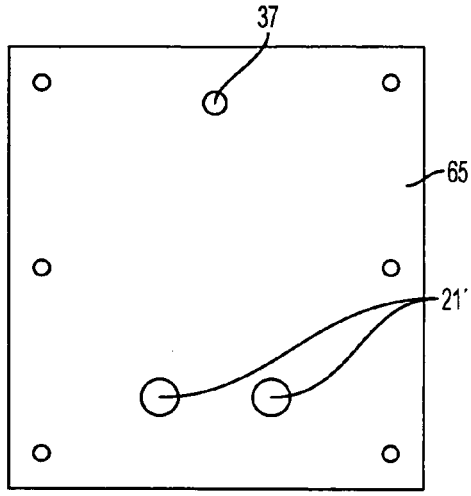
Figure 17:
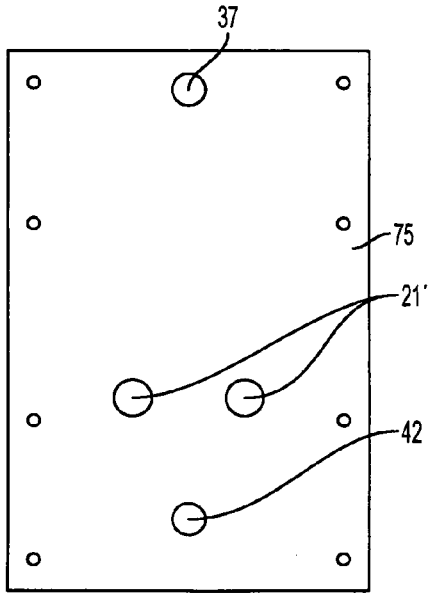

FIGS. 15–17 are further modifications of the invention showing different mounting configurations.

In FIG. 15 the mounting plate 55 has valve mechanisms openings 21' and spout opening 42. The openings 21' accommodate a conventional valve mechanism having two spaced water inlet pipes.

FIG. 16 shows an embodiment in which the mounting plate 65 has valve openings 21' and shower head pipe opening 37, and the mounting plate 75 of FIG. 17 includes valve opening 21', spout opening 42 and shower head pipe opening 37.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A method of assembling a faucet assembly to a surface having front and rear sides comprising:

providing a faucet assembly, providing a mounting plate, attaching the faucet assembly to the mounting plate, providing a backing member, attaching the backing member to the rear side of the surface, the backing member having at least one portion extending within a periphery of an opening in the surface, and attaching the mounting plate to the backing member in the at least one portion of the backing member extending within the periphery of the opening.

2. A surface mounting apparatus for a faucet assembly comprising:

a mounting plate having at least one hole to which the faucet assembly is attached;

a backing plate connected to the surface at a rear side thereof, the surface having a large opening defined therein, the backing plate having at least one portion that extends within the periphery of the opening; and fasteners attaching the mounting plate to the backing plate in the at least one portion of the backing plate that extends within the periphery of the opening thereby clampingly sandwiching the front and rear sides of the surface between the mounting and backing plates, and allowing removal of the mounting plate with the faucet assembly thereon for repair or replacement.

3. The apparatus of claim 2, further comprising flexible hoses attaching the faucet assembly to water input lines, the hoses allowing movement of the mounting plate away from the surface without removal of the hoses.

4. The apparatus of claim 3, wherein the water lines have shut-off valves that are accessible through the large opening.

5. The apparatus of claim 2, wherein the surface is a countertop.

6. The apparatus of claim 2, wherein the surface is part of a sink or bathtub.

7. The apparatus of claim 2, wherein the surface is a shower wall.

8. The apparatus of claim 7, wherein the mounting plate includes an opening through which a shower pipe extends.

9. The apparatus of claim 8, wherein the shower pipe is braced to the mounting plate.

10. The apparatus of claim 7, wherein the mounting plate includes an opening through which a bath spout extends.

11. The apparatus of claim 10, wherein the spout is attached to the mounting plate.

12. The apparatus of claim 10, wherein the mounting plate includes an opening through which a shower pipe extends.

13. The apparatus of claim 2, wherein the mounting plate includes at least two holes for attaching the faucet assembly thereto.

14. The apparatus of claim 2, wherein the mounting plate includes at least three holes for attaching the faucet assembly thereto.

15. The apparatus of claim 2, wherein the faucet assembly is a faucet and hot and cold water valves.

16. The apparatus of claim 2, wherein the backing plate is rigid and substantially non-flexible.

17. A surface mounting apparatus for a faucet assembly comprising:

a mounting plate, a backing plate configured to be connected to a rear side of the surface, the surface having a single large opening, and the backing plate having a single large opening similar in size to the large opening in the surface, the openings being substantially coextensive when the backing plate is connected to the surface, fasteners connecting the mounting plate to the backing plate, hoses extending from the faucet assembly through the large openings in the surface and backing plate, and water shut-off valves connected to the hoses, the shut-off valves being located at the rear side of the surface whereby when the mounting plate is disconnected from the backing plate, the shut-off valves are accessible by a user through the single large openings in the surface and backing plate.

* * * * *